US007261018B2

(12) United States Patent
Junkers

(10) Patent No.: US 7,261,018 B2
(45) Date of Patent: Aug. 28, 2007

(54) POWER TOOL

(75) Inventor: Jason Junkers, Park Ridge, NJ (US)

(73) Assignee: Jetyd Corp., Mahwah, NJ (US)

( * ) Notice: Subject to any disclaimer, the term of this patent is extended or adjusted under 35 U.S.C. 154(b) by 0 days.

(21) Appl. No.: 11/273,429

(22) Filed: Nov. 14, 2005

(65) Prior Publication Data

US 2007/0107558 A1 May 17, 2007

(51) Int. Cl.
*B25B 13/46* (2006.01)

(52) U.S. Cl. ..... 81/57.39; 81/57.36

(58) Field of Classification Search ..... 81/57.39, 81/57.36, 57.32, 180.1, 185, 62–63.2, 57.4, 81/462

See application file for complete search history.

(56) References Cited

U.S. PATENT DOCUMENTS 1,494,513 A * 5/1924 Stewart et al. ..... 81/61
4,429,597 A * 2/1984 Grabovac et al. ..... 81/57.39
4,480,510 A * 11/1984 Aparicio et al. ..... 81/57.39
4,513,645 A * 4/1985 Grabovac et al. ..... 81/57.39
4,722,252 A * 2/1988 Fulcher et al. ..... 81/57.39
5,140,874 A 8/1992 Junkers

* cited by examiner

*Primary Examiner*—Hadi Shakeri
(74) *Attorney, Agent, or Firm*—Michael J. Striker

(57) ABSTRACT

A power tool has a housing having a drive portion for turning a fastener to tighten or loosen the fastener, the drive portion having two opposite sides spaced from one another in one direction and two connecting elements spaced from one another in another direction which is transverse to the one direction, the connecting elements including a first connecting element to connect with a fastener to be turned and a second connecting element to connect with an adjacent fastener so as to stop the power tool from turning around the fastener to be turned. The connecting elements being movable in the one directions to a first position wherein both elements are on one side of the drive portion and to a second position wherein both elements are on the opposite side of the drive portion and being fixedly secured in the two positions.

4 Claims, 5 Drawing Sheets

POWER TOOL

BACKGROUND OF THE INVENTION

The present invention relates generally to power tools.

More particularly, it relates to power tools for tightening and loosening of fasteners, in which one part of the tool turns a fastener for tightening or loosening the same, while the other part of the tool reacts on an adjacent object, for example an adjacent nut and the like to stop the tool from turning around the fastener to be turned.

The power tools of the above mentioned general type are known in the art. One of such power tools is disclosed for example in our U.S. Pat. No. 5,140,874.

In practical use there are situations when several sets of fasteners are utilized, for example on a helicopter, in which several sets of bolts and nuts equally spaced from one another are used. The nuts are made to provide a high turning friction to assure that they do not come loose due to vibration. Therefore, turning the nuts by a power tool usually makes the bolt turn along. This is why a counter tool is required on the other side to stop the bolt from turning and to allow the fastener to tighten up.

It is believed that the existing power tools can be further improved.

SUMMARY OF THE INVENTION

Accordingly, it is an object of the present invention to provide a power tool for tightening and loosening or fasteners, which is a further improvement of the existing power tools.

In keeping with these objects and with others which will become apparent hereinafter, one feature of the present invention resides, briefly stated, in a power tool, comprising a housing having a drive portion for turning a fastener to tighten or loosen the fastener, said drive portion having two opposite sides spaced from one another in one direction and two connecting means spaced from one another-in another direction which is transverse to said one direction, said connecting means including first connecting means to connect with a fastener to be turned and second connecting means to connect with an adjacent fastener so as to stop the power tool from turning around the fastener to be turned, so that during tightening of the first mentioned fastener said first connecting means engages said first mentioned fastener on one of said sides of said drive portion while said second connecting means engages said adjacent fastener also on said one side of said drive portion, and during tightening of the adjacent fastener said first connecting means engages said adjacent fastener on the other side of said drive portion while said second connecting means engage said first mentioned fastener also on the other side of said drive portion.

When the power tool is designed in accordance with the present invention, it constitutes a further improvement of the existing tools.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
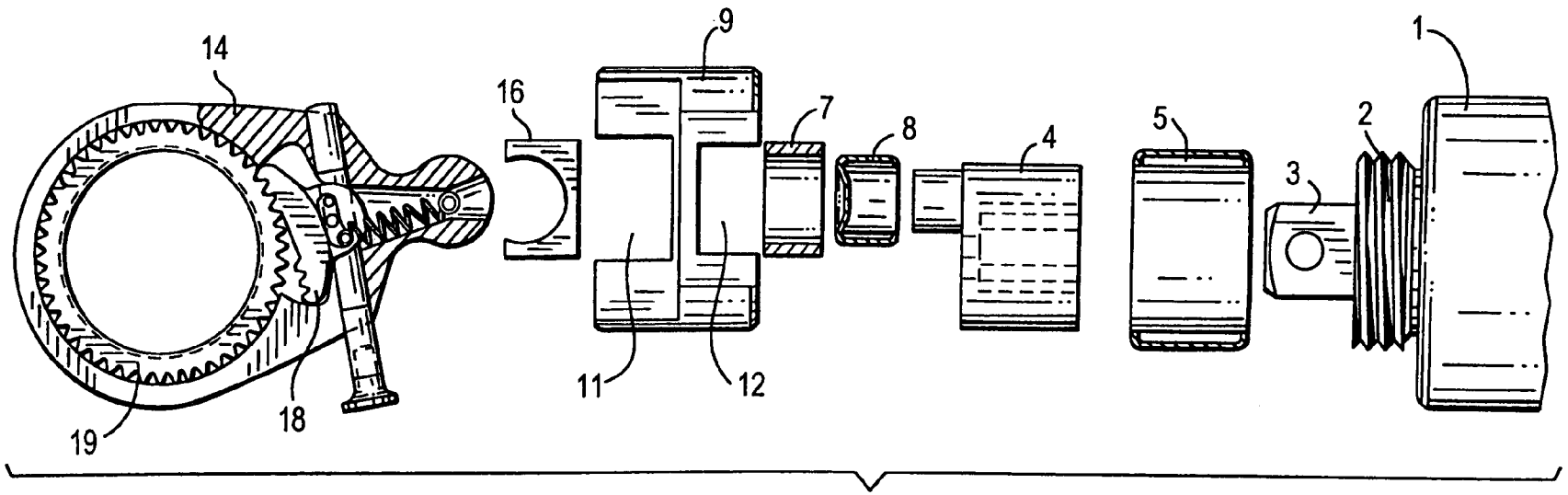
FIG. 1 is an exploded view of a power tool in accordance with the present invention.
Figure 3:
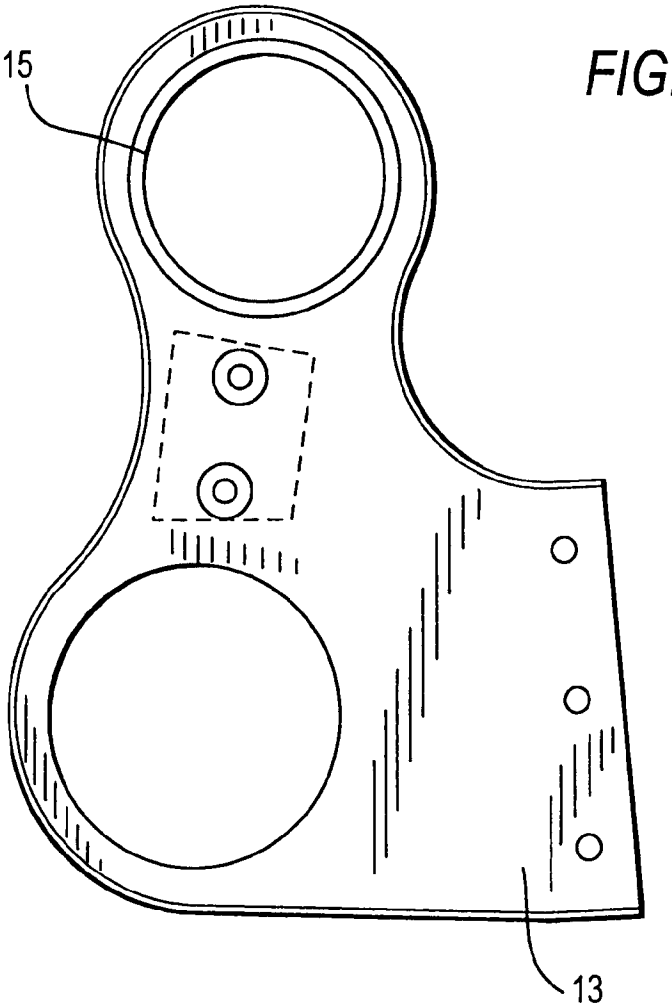
FIG. 3 is a side view of a side plate of the power tool in accordance with the present invention.
Figure 2:
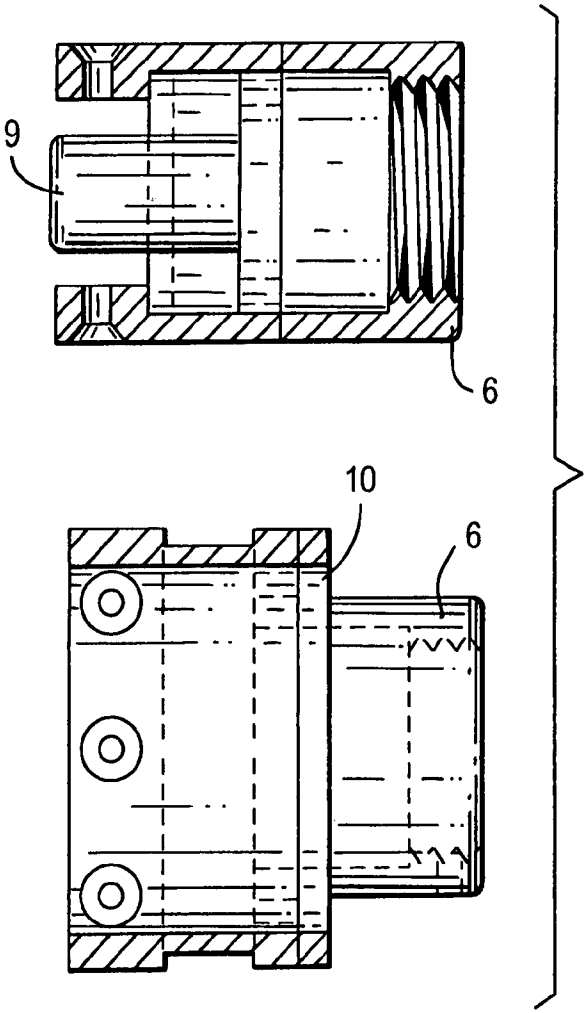
FIG. 2 is a view showing a cross-section and a side view of a cross-head of the inventive power tool in accordance with the present invention.
Figure 5:
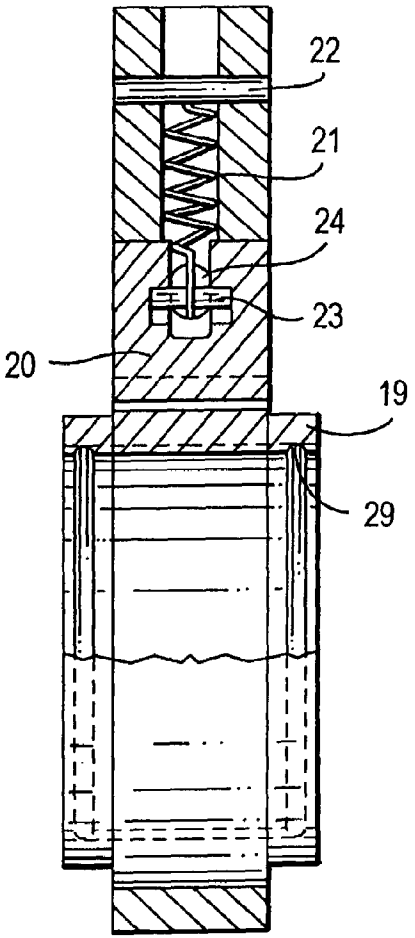
FIGS. 4 and 5 show a side view and a cross-section of a drive mechanism of the power tool in accordance with the present invention.
Figure 4:
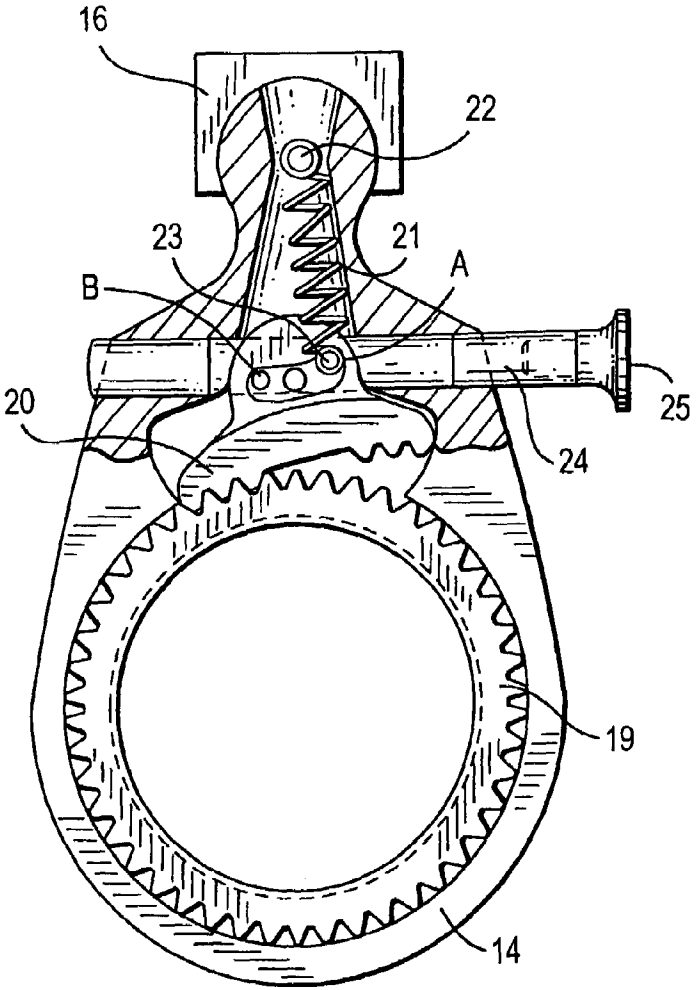
Figure 6:
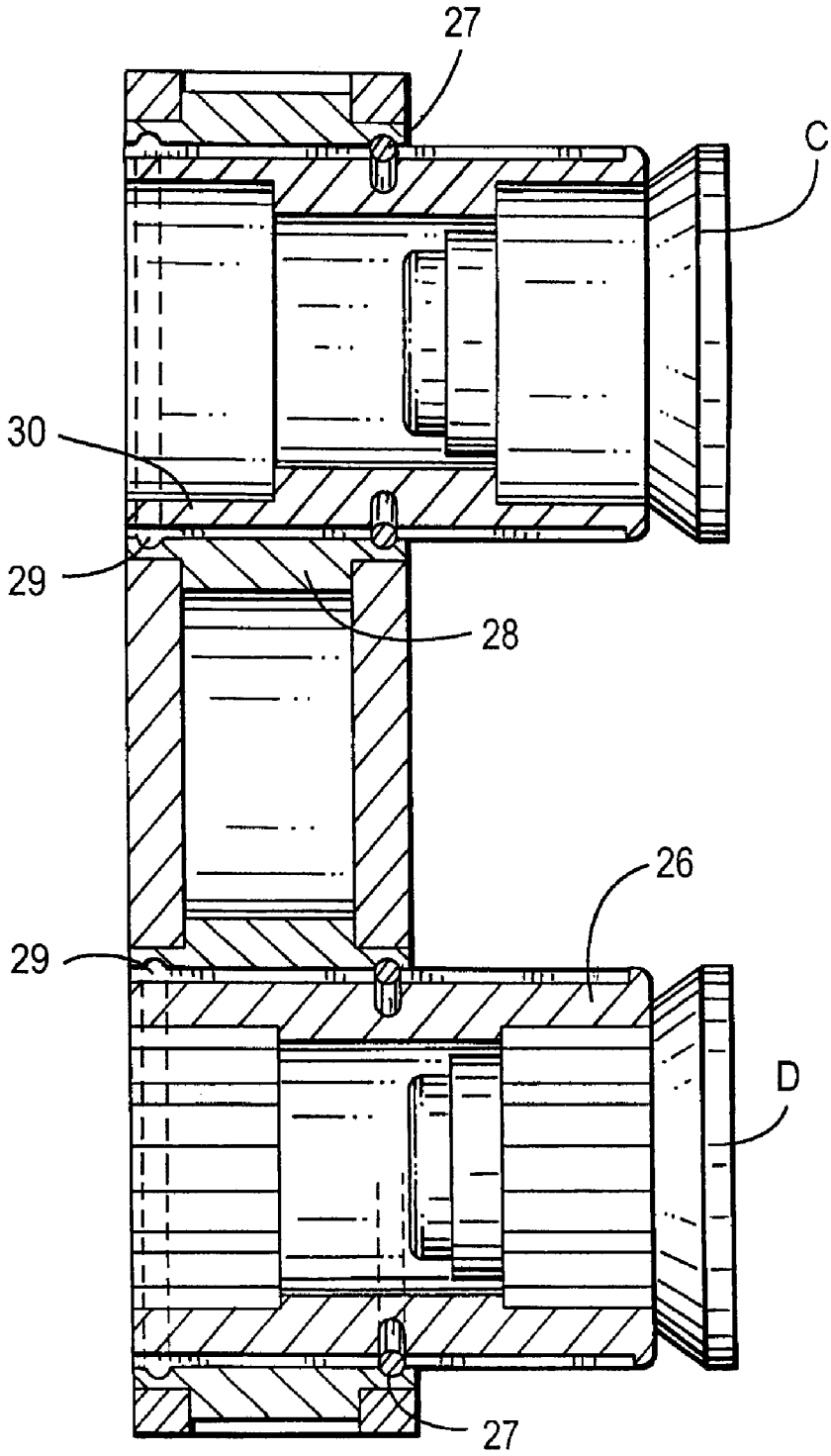
FIG. 6 is a view showing a cross-section of the side plate with parts of the drive mechanism of the power tool in accordance with the present invention.
Figure 7:
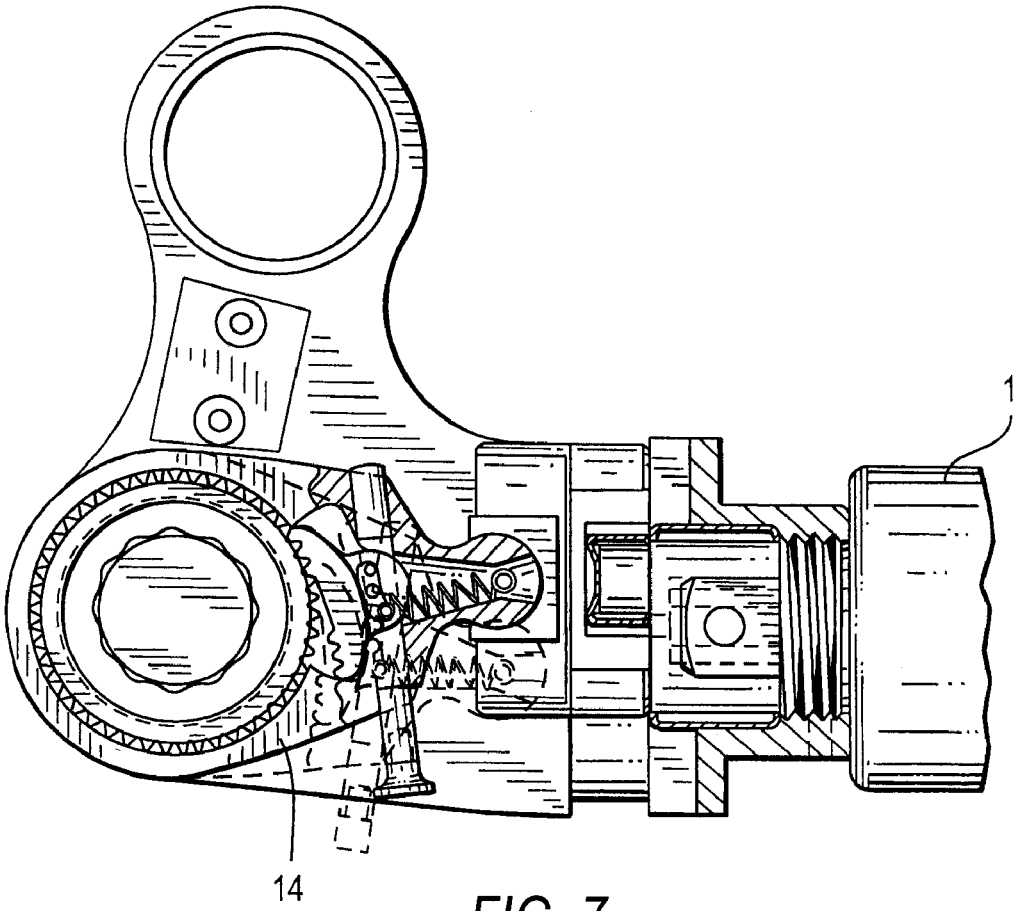
FIGS. 7 and 8 are a side view and a cross-section of the power tool in accordance with the present invention in assembled condition.
Figure 8:
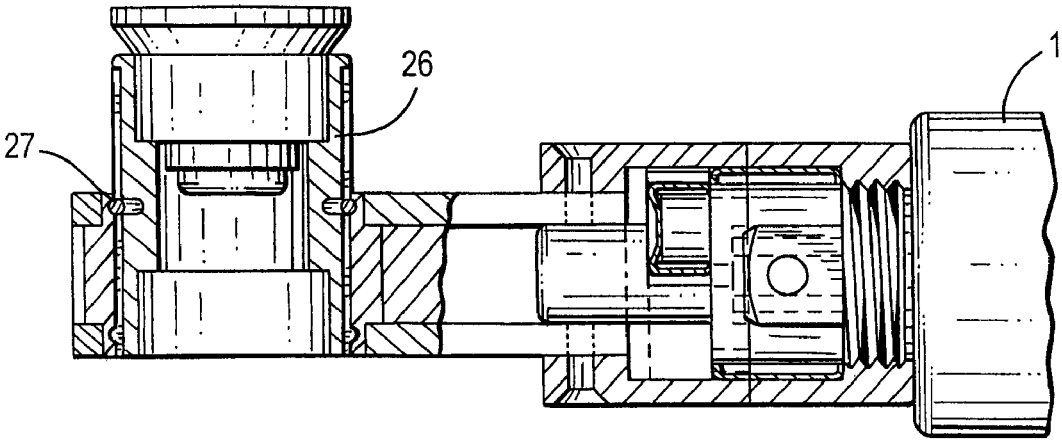

The power tool in accordance with the present invention has a motor power source provided for example by a dual speed air or electrically driven torque multiplier 1. The multiplier has a spline portion 2 which is concentric to a square drive element 3. A crank 4 which adapts to the square drive element 3 is located in a bearing 5 which is installed in an adaptor flange 6. A crank slider 7 is arranged via a bearing 8 on an offset crank pin of the crank 4.

A movable crosshead 9 is located in a crosshead housing 10. The crosshead housing 10 is screw connected to the adaptor flange 6 and side plates 13. The side plates 13 together form a drive portion of the housing of the power tool.

If a rotary motion is applied via the torque multiplier, the crank 4 moves the crank slider 7 within a slot 12 of the crosshead 9. The crosshead 9 is movable in the crosshead housing in a linear direction, so that the rotary motion of the crank 4 is converted into a linear bidirectional motion.

The side plates 13 are screw connected to the crosshead housing 10. A ratchet-drive plate assembly and a reaction sleeve 15 are mounted between the side plates 13 or in other words, in the drive portion of the housing.

A drive plate slider 16 is arranged over the drive plate 14 and engages in a slot 17 of the crosshead 9. The linear motion of the crosshead 9 is converted into a rotary motion of the ratchet-drive plate assembly.

The power tool is provided with a bidirectional ratcheting mechanism which is identified with reference numeral 18. It includes a ratchet 19 and a drive pawl 20. The drive pawl 20 pivots on a radius in the drive plate 13. A tension spring 21 is connected between pins 22 and 23. The drive pawl 20 can be formed as a two-pawl structure, etc.

The drive pawl 20 has a groove which allows a pin 23 to be moved between a position A and a position B by a switch pin 24, so as to reverse the action of the pawl. In each position A or B the pin 23 defines an axis of turning of the drive pawl 20. A pawl knob 25 is used to pull the switch pin 24.

A splined drive sleeve 26 engages a nut D to be tightened or loosened by the ratchet 19. The drive sleeve 26 is held in the ratchet 19 via a retaining ring 27. A reaction sleeve 30 is spaced from the drive sleeve 26 in a transverse direction and engages a nut C for reaction. A sleeve 28 is placed between the side plates 13. The reaction sleeve 30 is held in the sleeve 28 by a wire ring 27. The drive sleeve 26 and the reaction sleeve 30 are longer than a thickness of the drive portion of the housing including two side plates 13.

When it is necessary to tighten or loosen the nut D, the drive sleeve 26 is placed on the nut D and the reaction sleeve

30 is placed on the nut C, the power tool is activated. The ratcheting mechanism provides turning-of the ratchet 19, which in turn, turns the-drive sleeve 26 to turn the nut D for tightening or loosening, while the reaction sleeve 30 is held on the nut C to provide a reaction and to prevent turning of the tool around the nut D.

When the nut D has been tightened, it is then necessary to tighten the nut C. The drive sleeve 26 and the reaction sleeve 30 are pushed through the ratchet 29 and the sleeve 28 to extend to an opposite side of the drive portion of the housing until the wire rings 27 snap into grooves 29. The drive sleeve 26 is applied on the nut C, while the reaction sleeve 30 is applied on the nut D.

By actuating the reversing pin 24, the pin 23 inside the drive pawl 20 moves to another position. When now the power tool is activated, the ratchet 19 is turned in an opposite direction and turns the drive sleeve 26, which now will turn the nut C in the same direction, in which the nut D was turned before, to tighten or loosen the nut C.

The term "the same direction" is used to indicate that both nuts D and C have to be turned in the same direction for tightening, and they also have to be turned in the same direction for loosening.

The rotation of the drive sleeve 26 can be performed with at least two speeds, so that a higher turning speed provides a lower torque output than a lower turning speed.

It will be understood that each of the elements described above, or two or more together, may also find a useful application in other types of constructions differing from the types described above.

While the invention has been illustrated and described as embodied in a power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A power tool, comprising a housing having a drive portion for turning a fastener to tighten or loosen the fastener, said drive portion having two opposite sides spaced from one another in one direction and two connecting means spaced from one another in another direction which is transverse to said one direction, said two connecting means including a drive element for connecting with a fastener to be turned and a reaction element for connecting with an adjacent fastener so as to stop the power tool from turning around the fastener to be turned, so that during tightening of the first mentioned fastener said drive element engages said first mentioned fastener on one of said sides of said drive portion while said reaction element engages said adjacent fastener also on said one side of said drive portion, and during tightening of the adjacent fastener said drive element engages said adjacent fastener on the other side of said drive portion while said reaction element engage said first mentioned fastener also on the other side of said drive portion, wherein said drive element and said reaction element are movable through said portion to a first position to extend together outwardly only beyond said one side of said drive portion and to a second position to extend together outwardly only beyond said other side of said drive portion; and means for fixing said drive and reaction elements in said first and second positions, wherein said fixing means being provided in said elements and said drive portion and spaced from one another in said traverse direction.

2. A power tool as defined in claim 1; and further comprising means for switching a direction of turning of said drive element when going from the tightening of the first mentioned fastener to the tightening of the adjacent fastener.

3. A power tool as defined in claim 2, wherein said switching means includes a ratchet-pawl mechanism having a ratchet and a pawl, with said ratchet connected to said drive element and a pawl engageable with said ratchet; and an actuating element acting on said pawl so that said pawl engages said ratchet in two different modes providing turning of said ratchet in two opposite directions.

4. A power tool as defined in claim 3, wherein said actuating element includes a pin which defines an axis of turning of said pawl moves between two positions that determines said two different modes.

* * * * *